US009416509B2

(12) United States Patent
Theurer et al.

(10) Patent No.: US 9,416,509 B2
(45) Date of Patent: Aug. 16, 2016

(54) MACHINE GROUP AND METHOD FOR CLEANING BALLAST OF A TRACK

(75) Inventors: Josef Theurer, Vienna (AT); Herbert Woergoetter, Gallneukirchen (AT)

(73) Assignee: Plasser & Theurer, Export von Bahnbaumachinen, Gesellschaft m.b.H., Vienna (AT)

( * ) Notice: Subject to any disclaimer, the term of this patent is extended or adjusted under 35 U.S.C. 154(b) by 194 days.

(21) Appl. No.: 14/110,041

(22) PCT Filed: Mar. 8, 2012

(86) PCT No.: PCT/EP2012/001021

§ 371 (c)(1),
(2), (4) Date: Oct. 4, 2013

(87) PCT Pub. No.: WO2012/136297

PCT Pub. Date: Oct. 11, 2012

(65) Prior Publication Data

US 2014/0027133 A1 Jan. 30, 2014

(30) Foreign Application Priority Data

Apr. 5, 2011 (AT) ..... 479/2011

(51) Int. Cl.
*E01H 8/00* (2006.01)
*E01B 27/10* (2006.01)

(52) U.S. Cl.
CPC . *E01H 8/00* (2013.01); *E01B 27/10* (2013.01)

(58) Field of Classification Search
CPC ..... E01H 8/00; E01B 27/10
USPC ..... 104/2, 5, 7.1, 12; 171/16; 37/104, 105, 37/106
See application file for complete search history.

(56) References Cited

U.S. PATENT DOCUMENTS

| | | | | |
|---|---|---|---|---|
| 4,534,415 | A * | 8/1985 | Theurer et al. | 171/16 |
| 4,813,488 | A * | 3/1989 | Theurer | 171/16 |
| 4,858,696 | A * | 8/1989 | Theurer et al. | 171/16 |
| 5,029,649 | A * | 7/1991 | Kershaw et al. | 171/16 |
| 5,090,483 | A * | 2/1992 | Theurer et al. | 171/16 |
| 5,090,484 | A * | 2/1992 | Theurer et al. | 171/16 |
| 5,394,944 | A * | 3/1995 | Theurer et al. | 171/16 |
| 5,513,452 | A | 5/1996 | Theurer et al. | |
| 6,637,133 | B2 * | 10/2003 | Theurer et al. | 37/104 |

* cited by examiner

*Primary Examiner* — Robert Pezzuto
*Assistant Examiner* — Jessica H Lutz
(74) *Attorney, Agent, or Firm* — Laurence A. Greenberg; Werner H. Stemer; Ralph E. Locher

(57) ABSTRACT

A machine group for cleaning ballast of a track includes a first machine, having an endless clearing chain for ballast cleaning, and a second machine preceding the former with regard to a working direction and having a pick-up device for picking up cleaned ballast pre-deposited on the track. A third machine is arranged to precede the second machine. The third machine has two shoulder excavating devices for picking up the ballast located in a shoulder region of a ballast bed, and a second screening plant for cleaning the picked-up ballast.

2 Claims, 2 Drawing Sheets

MACHINE GROUP AND METHOD FOR CLEANING BALLAST OF A TRACK

BACKGROUND OF THE INVENTION

Field of the Invention

The invention relates to a machine group for cleaning ballast of a track which comprises a first machine, having an endless clearing chain for picking up the ballast located underneath the track and a first screening plant for a ballast cleaning, a second machine preceding the former with regard to a working direction and having a pick-up device for picking up cleaned ballast pre-deposited on the track, and a first conveyor belt arrangement for passing the cleaned ballast from the pick-up device on to a discharge point, situated rearward of the clearing chain, of the first machine. The invention also relates to a method for cleaning ballast of a track, wherein cleaned ballast pre-deposited on the same is picked up, transported to an intermediate store and discharged, as needed, rearward of a clearing chain of a machine designed for cleaning.

A machine group of this type is known from U.S. Pat. No. 5,513,452 and is composed of a cleaning machine and a machine preceding the same which has a pick-up device for picking up cleaned ballast pre-deposited on the track. Provided between the two machines is a storage wagon having bottom conveyor belts which are part of a conveyor belt arrangement extending from the said pick-up device to a discharge point of the cleaning machine. In this manner, it is possible to use the pre-deposited ballast for replenishing the ballast cleaned by the cleaning machine, as needed.

According to U.S. Pat. No. 5,090,484, it is also known to arrange a shoulder cleaning machine so as to precede a cleaning machine having an endless clearing chain. Positioned immediately ahead of the clearing chain is a device for picking up ballast pre-deposited on the track, in order to discharge said ballast upon the track immediately to the rear of the clearing chain. This, however, has the disadvantage that an adjustment to adapt to the current ballast demand is not possible.

BRIEF SUMMARY OF THE INVENTION

It is the object of the present invention to provide a machine group and a method of the type mentioned at the beginning with better higher work performance as well as improved ballast distribution can be accomplished.

According to the invention, this object is achieved with a machine group or a method of the type mentioned at the beginning by way of the inventive features as claimed.

Such a combination of features enables a parallel transfer of the ballast cleaned by the third machine, together with the ballast picked-up from the track by the second machine, to the discharge point of the first machine. Furthermore, any desired number of storage wagons, each having a bottom conveyor belt, can be incorporated without problems into this ballast transport without thereby negatively affecting the transport performance. Thus, in an advantageous way, the ballast picked up by both the third machine as well as the second machine can be intermediately stored and passed on, as needed.

Additional advantages of the invention become apparent from the drawing description.

BRIEF DESCRIPTION OF THE SEVERAL VIEWS OF THE DRAWING

The invention will be described in more detail below with reference to embodiments represented in the drawing in which.

DESCRIPTION OF THE INVENTION

Figure 1:
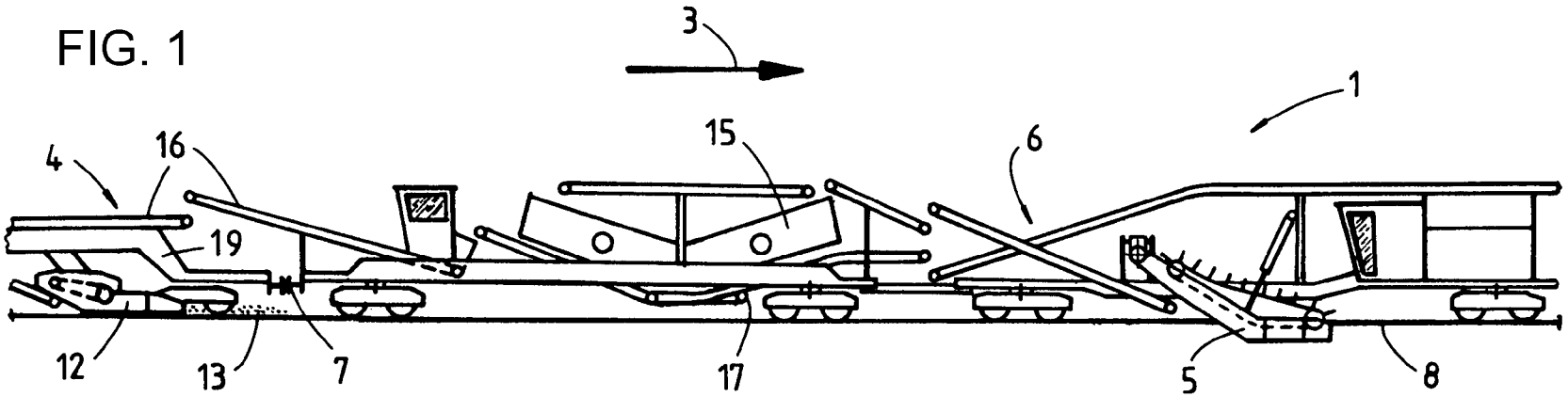
FIGS. 1 and 2 show a first variant and FIGS. 3 to 7 show a second variant of a machine group for cleaning ballast of a track.
Figure 2:
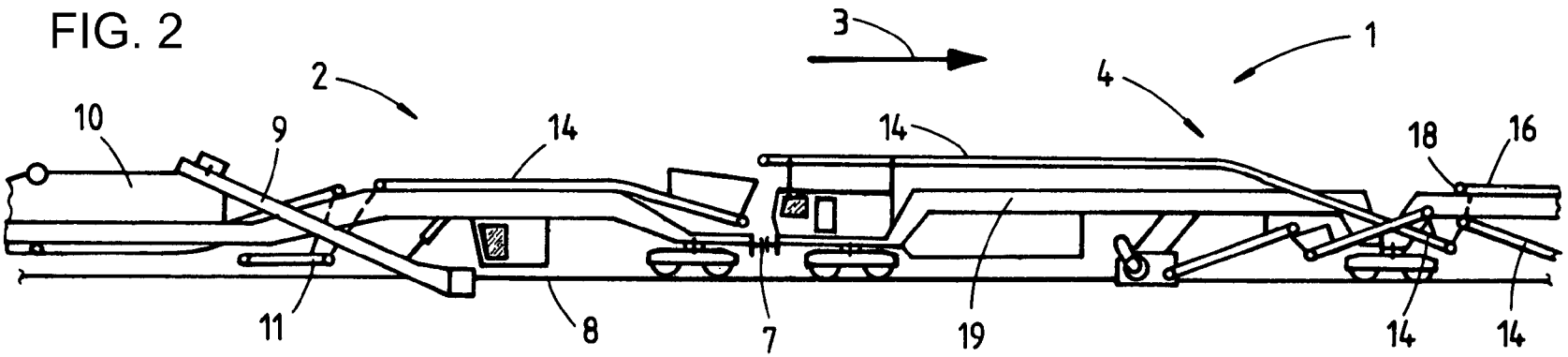
Figures 3, 4, 5, 6, 7:
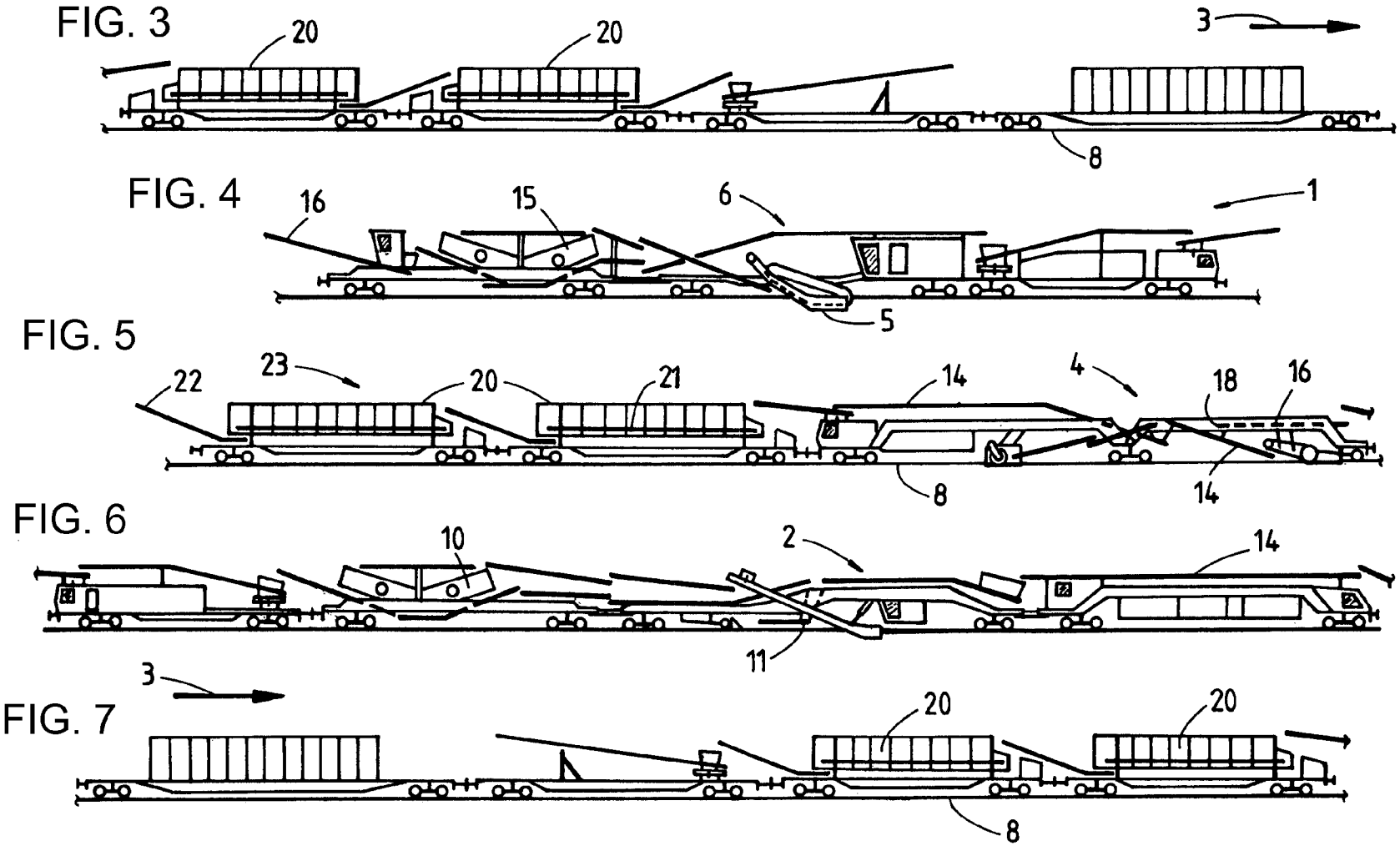

A machine group 1, shown in FIGS. 1 and 2, is composed of a first machine 2, configured as a cleaning machine, a second machine 4 preceding the same with regard to a working direction 3, and—preceding the latter—a third machine 6 equipped with shoulder excavating devices 5. The said machines 2, 4, 6 are connected to one another by couplings 7 and mobile on a track 8.

The first machine 2 has an endless clearing chain 9, guided around the track 8, and a first screening plant 10 which can be charged by the chain 9. Immediately to the rear of the clearing chain 9, a discharge point 11 for discharging the cleaned ballast upon the track 8 is provided.

The second machine 4, comprising a two-part machine frame 19, is equipped with a pick-up device 12 for picking-up cleaned ballast 13 pre-deposited on the track 8. A first conveyor belt arrangement 14 is provided for transferring the cleaned ballast 13 from the pick-up device 12 on to the discharge point 11, situated rearward of the clearing chain 9, of the first machine 2.

The third machine 6 has a second screening plant 15 for cleaning the ballast picked up by the shoulder excavating devices 5 from a shoulder region of a ballast bed. Provided for further transport of the ballast cleaned in the second screening plant 15 is a second conveyor belt arrangement 16. To that end, the latter has a receiving end 17, positioned underneath the second screening plant 15, and a discharge end 18 situated above the first conveyor belt arrangement 14.

The operating mode of the machine group 1, mobile continuously on the track 8 during working operations, and the method for cleaning ballast will now be described in more detail. The two shoulder excavating devices continuously pick up the ballast located in the shoulder region of the ballast bed, said ballast being cleaned in the second screening plant 15.

By means of the pick-up device 12, the second machine 4 picks up cleaned ballast pre-deposited on the track 8 and transports the same via the first conveyor belt arrangement 14 past the clearing chain 9 to the discharge point 11. Said first conveyor belt arrangement 14 also serves for transporting the cleaned ballast, coming from the second screening plant 15, on to the said discharge point 11.

By means of the first machine 2, the rest of the ballast still remaining under the track 8 is picked up, cleaned in the first screening plant 10, and also discharged via the discharge point 11 upon the track 8.

In the case of the alternative of a machine group 1 shown in FIGS. 3 to 7, machine parts already described with reference to FIGS. 1 and 2 and having the same function are denoted by the same reference numerals for the sake of simplicity. The essential difference lies in the fact that intermediate stores 23 in the shape of special storage wagons 20 are arranged between the first and second machine 2, 4. These intermediate stores 23 each have a bottom conveyor belt 21 and a transfer conveyor belt 22, both forming a section of the first conveyor belt arrangement 14. Owing to these storage wagons 20, there is the possibility of storing both the ballast picked up from the track 8 by means of the second machine 4 as well as the ballast coming from the second screening plant 15. By varying the speed of the conveyor belts 21, 22, the stored ballast can be transported onward to the discharge point 11 as needed and in the required amounts.

Additional storage wagons 20 are positioned following or preceding the first and third machine 2, 6 in order to store the spoil accruing in the screening plants 10, 15, respectively.

The invention claimed is:

1. A machine group for cleaning ballast of a track, the machine group comprising:

a) a first machine having an endless clearing chain configured for picking up the ballast located underneath the track and a first screening plant for ballast cleaning;

b) a second machine preceding said first machine with regard to a working direction, said second machine having a pick-up device for picking up cleaned ballast pre-deposited on the track;

c) a first conveyor belt arrangement for passing the cleaned ballast from said pick-up device on to a discharge point, situated rearward of said clearing chain of said first machine;

d) a third machine preceding said second machine, said third machine having two shoulder excavating devices for picking up the ballast situated in a shoulder region of a ballast bed, and a second screening plant for cleaning the picked-up ballast;

e) a second conveyor belt arrangement for transporting ballast in a longitudinal direction of the machine, said second conveyor belt arrangement having a receiving end situated underneath said second screening plant and a discharge end positioned above said first conveyor belt arrangement.

2. A method of cleaning ballast of a track, the method comprising:

picking up cleaned ballast pre-deposited on the track;

transporting the cleaned ballast to an intermediate storage device and discharging the cleaned ballast, as needed, rearward of a clearing chain of a machine configured for cleaning;

in parallel with the picking up and transporting steps, picking up ballast located in a shoulder region of a ballast bed and cleaning the ballast to make cleaned ballast;

thereafter transporting the cleaned ballast, together with ballast pre-deposited on the track and picked up from the track, to the intermediate storage device and discharging the cleaned ballast, as needed, rearward of the clearing chain.

* * * * *